US010431407B2

(12) United States Patent
Delpozzo et al.

(10) Patent No.: US 10,431,407 B2
(45) Date of Patent: Oct. 1, 2019

(54) MEDIUM VOLTAGE CONTACTOR

(71) Applicant: ABB Schweiz AG, Baden (CH)

(72) Inventors: Andrea Delpozzo, Torbiato di Adro (IT); Emanuele Morelli, Linarolo (IT); Osvaldo Prestini, Nembro (IT); Veronica Biagini, Ladenburg (DE); Christian Simonidis, Karlsruhe (DE)

(73) Assignee: ABB Schweiz AG, Baden (CH)

( * ) Notice: Subject to any disclaimer, the term of this patent is extended or adjusted under 35 U.S.C. 154(b) by 71 days.

(21) Appl. No.: 15/621,511

(22) Filed: Jun. 13, 2017

(65) Prior Publication Data

US 2017/0358412 A1 Dec. 14, 2017

(30) Foreign Application Priority Data

Jun. 13, 2016 (EP) ..... 16174129

(51) Int. Cl.
*H01H 50/36* (2006.01)
*H01H 50/56* (2006.01)
(Continued)

(52) U.S. Cl.
CPC ..... *H01H 50/18* (2013.01); *H01F 1/14766* (2013.01); *H01H 3/28* (2013.01);
(Continued)

(58) Field of Classification Search
CPC ..... H01F 1/14766; H01H 2235/01; H01H 33/38; H01H 33/6662; H01H 3/28; H01H 3/30; H01H 50/18; H01H 50/36; H01H 50/56; H01H 51/2209
(Continued)

(56) References Cited

U.S. PATENT DOCUMENTS 6,130,594 A * 10/2000 Morant ..... H01H 33/6662 335/230
6,156,989 A * 12/2000 Miller ..... H01H 33/666 218/120
(Continued)

FOREIGN PATENT DOCUMENTS

| | | | |
|---|---|---|---|
| EP | 1619707 | A1 | 1/2006 |
| WO | 2011000744 | A1 | 1/2011 |
| WO | 2015098145 | A1 | 7/2015 |

OTHER PUBLICATIONS

European Search Report, EP16174129.3, ABB Technology AG, dated Nov. 16, 2016, 7 pages.

*Primary Examiner* — Henry T Crenshaw
(74) *Attorney, Agent, or Firm* — J. Bruce Schelkopf; Taft Stettinius & Hollister LLP

(57) ABSTRACT

Systems, methods, techniques and apparatuses of contactors are disclosed. One exemplary embodiment is a contactor including an electric pole, a pair of plungers, and a pair of opening springs. The electric pole includes a fixed yoke member and a movable yoke member arranged respectively at a proximal position and a distal position with respect to a movable contact. The fixed yoke member includes a pair of through holes. The pair of second plungers are inserted in a corresponding through hole passing through the fixed yoke member and symmetrically positioned with respect to a main symmetry plane of the contactor, which is parallel to a displacement axis of the movable contact and perpendicular to a displacement plane of the movable contact. The pair of opening springs are symmetrically positioned with respect to the main symmetry plane.

17 Claims, 10 Drawing Sheets

(51) Int. Cl.

| | |
|---|---|
| ***H01H 3/28*** | (2006.01) |
| ***H01H 33/38*** | (2006.01) |
| ***H01H 33/666*** | (2006.01) |
| ***H01F 1/147*** | (2006.01) |
| ***H01H 3/30*** | (2006.01) |
| ***H01H 50/18*** | (2006.01) |
| *H01H 51/22* | (2006.01) |

(52) U.S. Cl.
CPC ..... *H01H 3/30* (2013.01); *H01H 33/38* (2013.01); *H01H 33/6662* (2013.01); *H01H 50/36* (2013.01); *H01H 50/56* (2013.01); *H01H 51/2209* (2013.01); *H01H 2235/01* (2013.01)

(58) Field of Classification Search
USPC ..... 62/511
See application file for complete search history.

(56) References Cited

U.S. PATENT DOCUMENTS

| | | | | |
|---|---|---|---|---|
| 8,502,419 | B2 * | 8/2013 | Suardi | H01H 33/38 307/143 |
| 2006/0006146 | A1 * | 1/2006 | Prestini | H01H 33/6662 218/154 |
| 2009/0039989 | A1 * | 2/2009 | Reuber | H01F 7/1646 335/127 |
| 2011/0046808 | A1 * | 2/2011 | Kellis | H01H 47/002 700/293 |
| 2012/0119856 | A1 * | 5/2012 | Prestini | H01H 3/227 335/164 |
| 2012/0169441 | A1 | 7/2012 | Kim et al. | |
| 2013/0015712 | A1 * | 1/2013 | Usai | H01H 3/28 307/64 |
| 2015/0022297 | A1 | 1/2015 | Kim et al. | |

* cited by examiner

1

MEDIUM VOLTAGE CONTACTOR

The present invention relates to a contactor (e.g. a vacuum contactor) for medium voltage electric systems.

For the purpose of the present application, the term "medium voltage" (MV) relates to operating voltages at electric power distribution level, which are higher than 1 kV AC and 1.5 kV DC up to some tens of kV, e.g. up to 72 kV AC and 100 kV DC.

As is known, MV electric systems typically adopt two different kinds of switching devices.

A first type of switching devices, including for example circuit breakers, is basically designed for protection purposes, namely for carrying (for a specified time interval) and breaking currents under specified abnormal circuit conditions, e.g. under short circuit conditions.

A second type of switching devices, including for example contactors, is basically designed for manoeuvring purposes, namely for carrying and breaking currents under normal circuit conditions including overload conditions.

A widely used type of MV contactors is represented by MV vacuum contactors.

These apparatuses are quite suitable for installation in harsh environments (such as in industrial and marine plants) and are typically used in control and protection of motors, transformers, power factor correction banks, switching systems, and the like.

MV vacuum contactors comprise, for each electric pole, a vacuum bulb in which the electrical contacts are placed to mutually couple/decouple upon actuation by a suitable actuating device. Some MV vacuum contactors of the state of the art (of the so-called "bi-stable" type) adopt an electromagnetic actuator to move the movable contacts from a decoupled position to a coupled position with respect to the fixed contacts, and vice-versa.

Examples of these MV vacuum contactors are disclosed in patent applications EP1619707A1 and WO2011/000744.

As the electromagnetic actuator has to be fed with proper levels of electric power during both the closing and opening maneuvers of the movable contacts, these contactors are arranged with on-board electric energy storage systems (e.g. capacitor banks or batteries) and complex drive circuits to ensure a proper and, above all, safe operation thereof.

Therefore, these apparatuses may be of problematic usage and are generally quite time-consuming and expensive to assembly and manufacture at industrial level.

This last drawback is made even more critical when the electromagnetic actuator is provided (as it often occurs) with rare-earth permanent magnets notoriously produced with highly expensive materials.

Other MV vacuum contactors of the state of the art (of the so-called "mono-stable" type) adopt an electromagnetic actuator to move the movable contacts from a decoupled position to a coupled position with respect to the fixed contacts and opening springs to move the movable contacts from a coupled position to a decoupled position with respect to the fixed contacts.

Generally, currently available contactors of this type are provided with complex kinematic chains (normally including roto-translational mechanisms) to transmit forces to the movable contacts and with complex arrangements to house and guide the opening springs during operation.

Also these apparatuses typically have a cumbersome structure and are time-consuming and expensive to assembly and manufacture at industrial level.

The main aim of the present invention is to provide a contactor for MV electric systems that allows solving or mitigating the above mentioned problems.

More in particular, it is an object of the present invention to provide a contactor having high levels of reliability for the intended applications.

As a further object, the present invention is aimed at providing a contactor having a relative simple and space-saving structure.

Still another object of the present invention is to provide a contactor that can be easily manufactured at industrial level, at competitive costs with respect to the solutions of the state of the art.

In order to fulfill these aim and objects, the present invention provides a contactor, according to the following claim 1 and the related dependent claims.

In a general definition, the contactor, according to the invention, comprises one or more electric poles.

Preferably, the contactor, according to the invention, is of the multi-phase (e.g. three-phase) type, thereby comprising a plurality (e.g. three) of electric poles.

For each electric pole, the contactor, according to the invention, comprises a fixed contact and a movable contact.

The one or more movable contacts of the contactor are reversibly movable along corresponding displacement axes mutually parallel and lying on a common displacement plane.

Each movable contact is reversibly movable between a first position, at which it is decoupled from the corresponding fixed contact, and a second position, at which it is coupled with the corresponding fixed contact.

The contactor, according to the invention, comprises an armature reversibly movable along a corresponding displacement direction parallel to the displacement axes of said movable contacts, between a third position and a fourth position.

Advantageously, the third and fourth positions of the movable armature correspond respectively to the first and second positions of the movable contacts of the contactor.

Preferably, said movable armature is shaped as a beam having a corresponding main longitudinal axis perpendicular to the displacement axes of said movable contacts and parallel to the displacement plane of said movable contacts.

The contactor, according to the invention, comprises, for each electric pole, a first plunger solidly connected with said movable armature and with a corresponding movable contact to transmit mechanical forces to said movable contact.

Each of said first plungers extends along a corresponding main longitudinal axis parallel or coinciding with the displacement axis of a corresponding movable contact of the contactor.

The contactor, according to the invention, comprises an electromagnetic actuator provided with a magnetic yoke forming a magnetic circuit.

Said magnetic yoke comprises a fixed yoke member and a movable yoke member.

The movable yoke member is reversibly movable, along a corresponding displacement direction parallel to the displacement axes of said movable contacts, between a fifth position, at which it is decoupled from said fixed yoke member, and a sixth position, at which it is coupled with said fixed yoke member.

Advantageously, the fifth and sixth positions of the movable yoke member correspond, respectively, to the third and fourth positions of the movable armature and, consequently to the first and second positions of the movable contacts of the contactor.

The electromagnetic actuator further comprises a coil wound around the fixed yoke member. Said coil is adapted to be fed by a coil current to make the fixed yoke member to magnetically interact with the movable yoke member and, as a consequence of such an interaction, move the movable yoke member from said fifth position to said sixth position or maintain said movable yoke member in said sixth position.

In particular, the electromagnetic actuator is adapted to provide a mechanical force to move the movable contacts of the contactor during a closing manoeuver of this latter or adapted to maintain the movable contacts of the contactor coupled with the respective fixed contacts, i.e. in the above mentioned second position (closing position).

The contactor, according to the invention, comprises one or more opening springs positioned between the fixed yoke member and the movable yoke member.

Said opening springs are adapted to provide a mechanical force to move the movable yoke member from said sixth position to said fifth position, upon interruption of the coil current feeding the coil of the electromagnetic actuator.

In particular, said opening springs are adapted to provide a mechanical force to move the movable contacts of the contactor during an opening manoeuver of this latter.

The contactor, according to the invention, comprises a plurality of second plungers coupled with said movable yoke member and said movable armature to transmit mechanical forces to said movable armature and, consequently, to move said movable contacts.

Each of said second plungers extends along a corresponding main longitudinal axis parallel to the displacement axes of said movable contacts.

Preferably, the displacement direction of said movable armature, the displacement direction of said movable yoke member, the main longitudinal axes of said first plungers and the main longitudinal axes of said second plungers lye on the displacement plane of said movable contacts.

Preferably, the contactor comprises, for each electric pole, a contact spring positioned between a corresponding fixed rest surface and said movable armature.

Each contact spring is adapted to provide a mechanical force directed in such a way to oppose to any separation of the electric contacts of the corresponding electric pole, when said electric contacts are in a closing position. In this way, possible bounces of the movable contacts due to electrodynamic repulsion phenomena are reduced when the contactor is in a closing state.

However, each contact spring advantageously provides also a mechanical force to move said movable armature from said third position towards said fourth position. In particular, the contact springs of the contactor are adapted to provide a mechanical energy to start moving said movable armature (and consequently the movable contacts of the contactor) during an opening manoeuver of this latter.

According to an embodiment of the invention:

said fixed yoke member and said movable yoke member are arranged respectively at a proximal position and a distal position with respect to said movable contacts;

the contactor comprises a pair of said second plungers symmetrically positioned with respect to a main symmetry plane of said contactor, said symmetry plane being parallel to the displacement axes of said movable contacts and perpendicular to the displacement plane of said movable contacts;

the contactor further comprises a pair of said opening springs symmetrically positioned with respect to said main symmetry plane;

said fixed yoke member comprises a pair of through holes, each of said second plungers being inserted in a corresponding through hole and passing through said fixed yoke member.

According to an embodiment of the invention:

said fixed yoke member comprises a main portion in a proximal position with respect to said movable contacts and shaped as a beam having a main longitudinal axis perpendicular to the displacement axes of said second movable contacts and parallel to the displacement plane of said movable contacts;

said fixed yoke member further comprises a pair of lateral limb portions, each of said lateral limb portions being positioned at a corresponding end of said main portion and protruding from said main portion towards said movable yoke member, each of said lateral limb portions having a corresponding free end in a distal position with respect to said movable contacts, the free ends of said lateral limb portions being coupled with said movable yoke member, when said movable yoke member in said sixth position;

said fixed yoke member further comprises an intermediate limb portion positioned between said lateral limb portions and protruding from said main portion towards said movable yoke member, said intermediate limb portion having a corresponding free end in a distal position with respect to said main portion;

said movable yoke portion is shaped as a beam having a main longitudinal axis perpendicular to the displacement axes of said second movable contacts and parallel to the displacement plane of said movable contacts.

Preferably, the free ends of said lateral limb portions are coupled with said movable yoke member, when said movable yoke member in said sixth position.

Preferably, the free end of said intermediate limb portion is separated from said movable yoke member, when said movable yoke member in said sixth position.

Preferably, the coil of said electromagnetic actuator is wound around the intermediate limb portion of said fixed yoke member.

Preferably, each through hole of said fixed yoke member is coaxial with a corresponding lateral limb portion of said fixed yoke member.

Preferably, each second plunger of said contactor is inserted in a corresponding through hole and passes through a corresponding lateral limb portion of said fixed yoke member and the main portion of said fixed yoke member.

Preferably, each opening spring of the contactor is coupled with the main portion of said fixed yoke member and with said movable yoke member.

Preferably, each opening spring of the contactor is positioned coaxially with a corresponding lateral limb portion of said fixed yoke member and outwardly surrounds said corresponding lateral limb portion.

Preferably, the contactor, according to the invention, is of the vacuum type. In this case, for each electric pole, the contactor comprises a vacuum chamber, in which a corresponding pair of movable and fixed contacts is placed to be mutually coupled/decoupled.

Further characteristics and advantages of the invention will emerge from the description of preferred, but not exclusive embodiments of the contactor, according to the invention, non-limiting examples of which are provided in the attached drawings, wherein.

Figure 1:
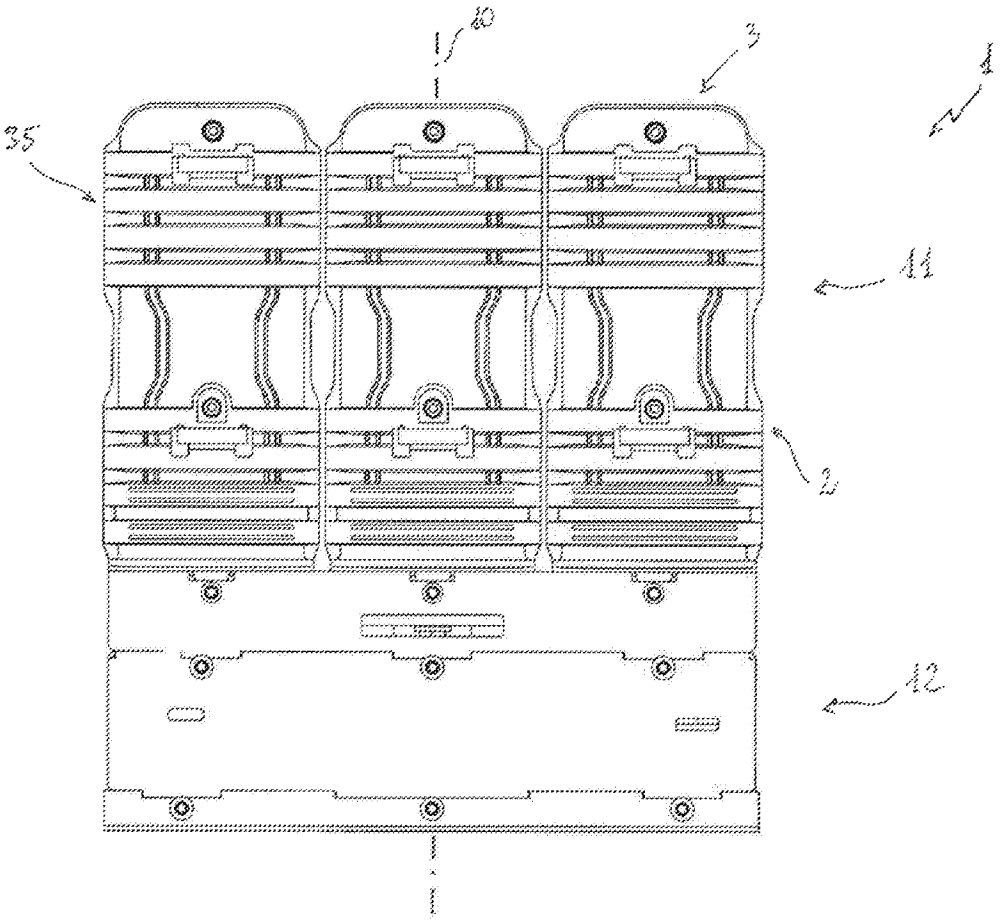
FIG. 1 is a frontal view of the contactor, according to the invention.

With reference to the figures, the present invention relates to a contactor 1 for medium voltage (MV) electric systems.

The contactor 1 comprises a breaking section 11 and an actuation section 12, which respectively include the electric poles and the actuation components of the contactor.

Taking as a reference a normal installation position of the contactor, shown in the cited figures, the breaking section 11 is overlapped to the actuation section 12.

The contactor 1 comprises an outer case 2 preferably made of electrically insulating material of known type (e.g. thermoplastic materials such as polyamide or polycarbonate or thermosetting materials such as polyester or epoxy resins and the like).

The outer case 2 is adapted to be fixed to a support (not shown) during the installation of the contactor 1.

The contactor 1 comprises one or more electric poles 3.

Preferably, the contactor 1 is of the multi-phase type, more particularly of the three-phase type, as shown in the cited figures.

Preferably, each electric pole 3 comprises a corresponding insulating housing 35, which is part of the outer case 2 at the breaking section 11 of this latter.

Preferably, each housing 35 is formed by an elongated (e.g. cylindrical) hollow body of electrically insulating material of known type.

Preferably, each housing 35 defines an internal volume, in which the components of the corresponding electric pole 3 are accommodated.

Advantageously, each electric pole 3 comprises a first pole terminal 36 and a second pole terminal 37, which may be mechanically fixed to the housing 35 by means of flanges.

The pole terminals 36, 37 are adapted to be electrically connected with a corresponding electric conductor (e.g. a phase conductor) of an electric line.

For each electric pole 3, the contactor 1 comprises a fixed contact 31 and a movable contact 32, which are electrically connected to the first and second pole terminals 36, 37 respectively.

Figure 2:
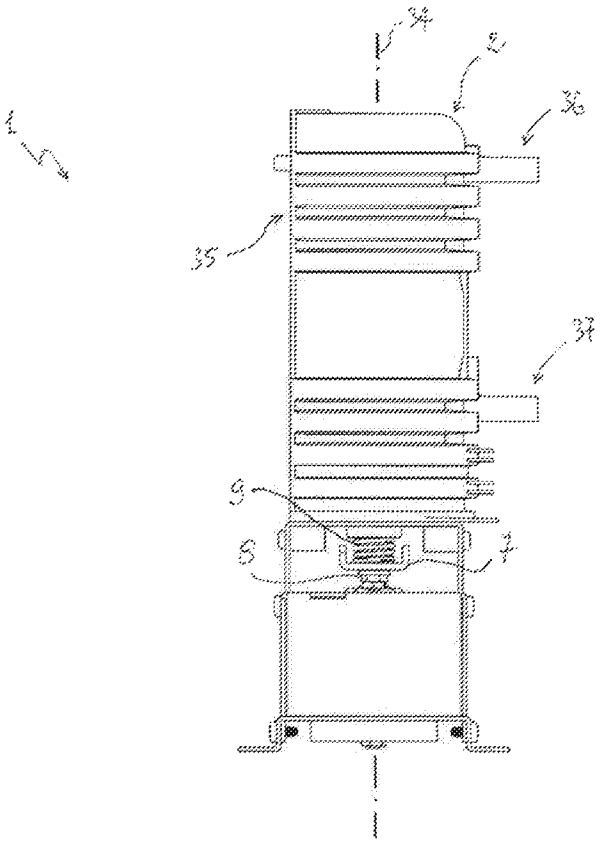
FIG. 2 is a side view of the contactor, according to the invention.
Figure 3:
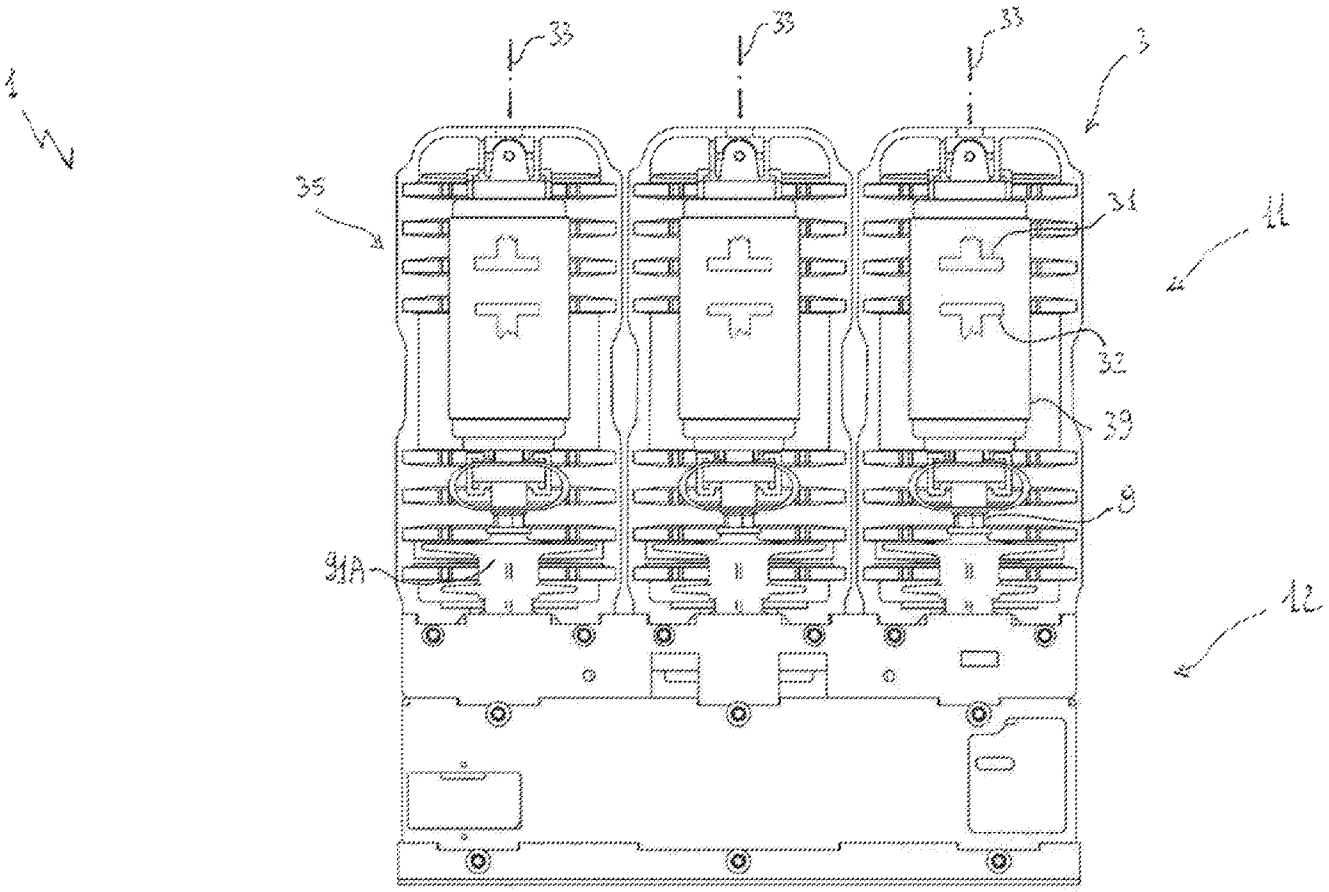
FIG. 3 is a partial section view showing the electric poles of the contactor, according to the invention.
Figure 4:
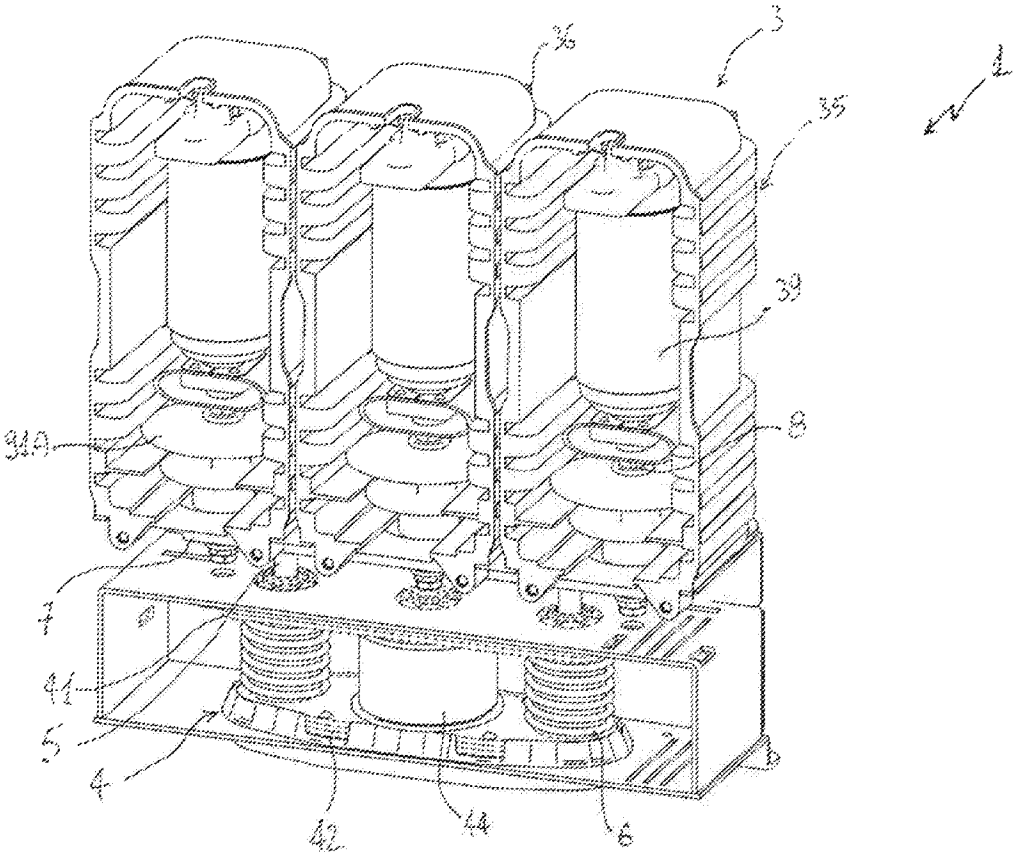
FIG. 4 is a section view showing the contactor, according to the invention.

The movable contacts 32 are reversibly movable, along corresponding displacement axes 33 (e.g. forming the main longitudinal axes of the electric poles 3) that are mutually parallel (FIG. 1) and lye on a common displacement plane 34 (FIG. 2).

Figure 5:
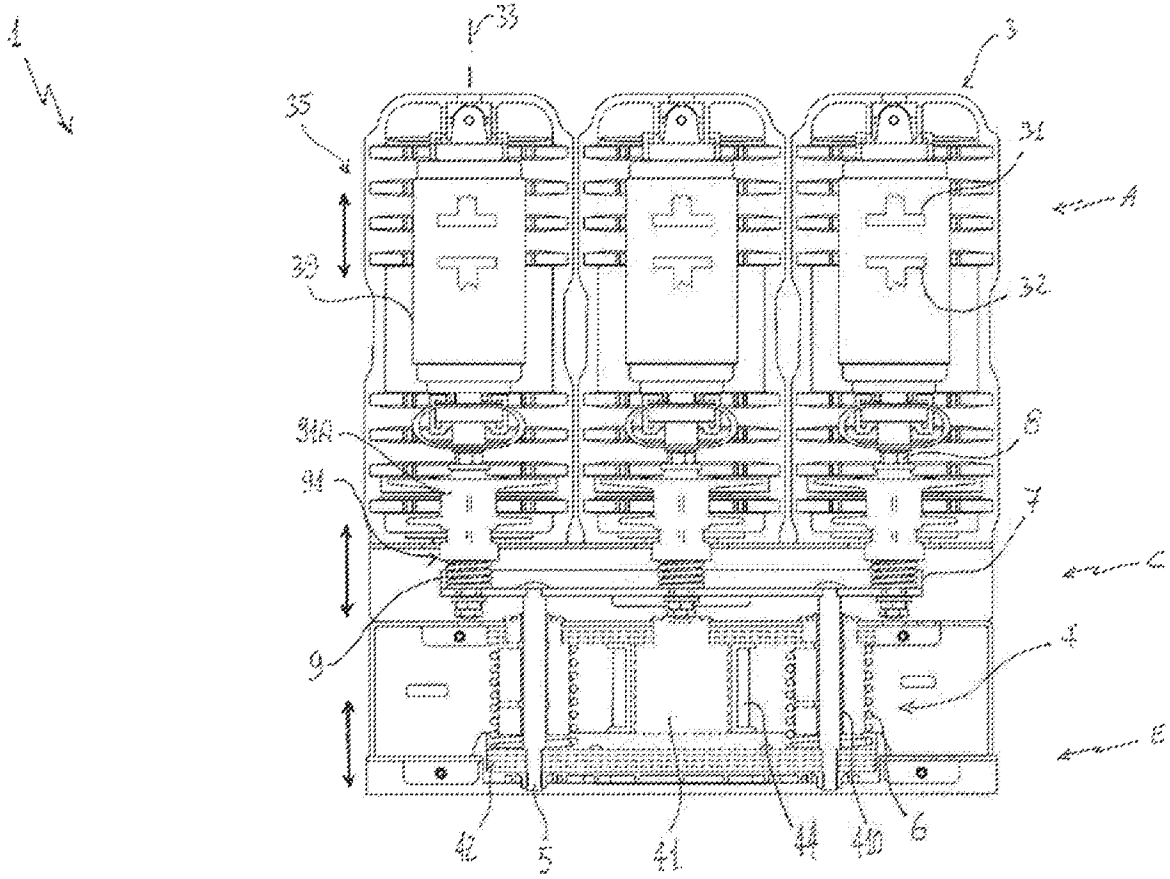
FIGS. 5-6 are section views showing the contactor, according to the invention, in different operating positions.
Figure 6:
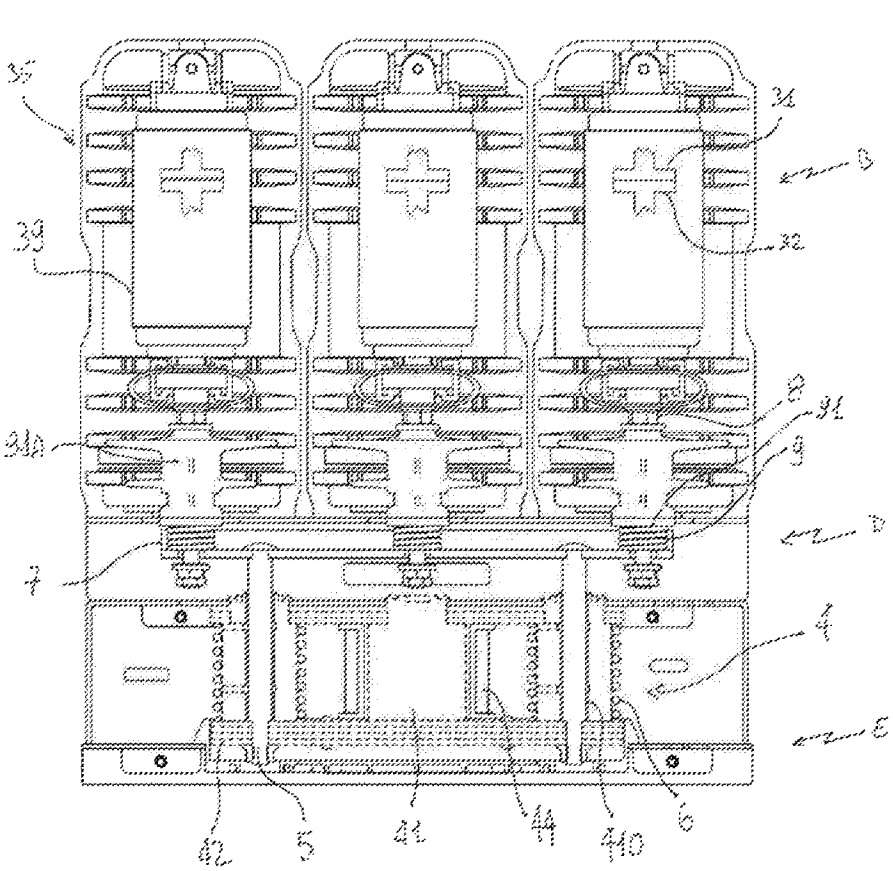

In particular, the movable contacts 32 are reversibly movable (see the corresponding bidirectional displacement arrow FIG. 5) between a first position A (opening position), at which they are decoupled from the corresponding fixed contacts 31, and a second position B (closing position), at which they are coupled with the corresponding fixed contacts 31 (FIGS. 5-6).

The passage of the movable contacts 32 from the first position A to the second position B represents a closing manoeuver of the contactor 1 whereas the passage of the movable contacts 32 from the second position B to the first position A represents an opening manoeuver of the contactor 1.

Preferably, the contactor 1 is of the vacuum type.

In this case, for each electric pole 3, the contactor 1 comprises a vacuum chamber 39 that may be of known type.

In each vacuum chamber 39, a corresponding pair of movable and fixed contacts 31, 32 is placed and can be mutually coupled/decoupled.

The contactor 1 comprises a movable armature 7 reversibly movable along a displacement direction parallel to, and preferably co-planar with, the displacement axes 33 of the movable contacts 32 (see the corresponding bi-directional displacement arrow FIG. 5).

In particular, the movable armature 7 is reversibly movable between a third position C and a fourth position D (FIGS. 5-6).

The third and fourth positions C, D of the movable armature 7 advantageously correspond to the first and second positions A, B of the movable contacts 32, respectively.

Preferably, the movable armature 7 is formed by a beam of metallic material of known type (e.g. non-ferromagnetic steel or aluminium), which has a corresponding main longitudinal axis perpendicular to the displacement axes 33 of the movable contacts 32 and parallel to the displacement plane 34 of said movable contacts.

Preferably, the armature 7 is part of the actuation section 12 of the contactor 1, at a proximal position with respect to the movable contacts 32.

The contactor 1 comprises, for each electric pole 3, a first plunger 8 of non-ferromagnetic, electrically insulating material of known type (e.g. (e.g. thermoplastic materials such as polyamide or polycarbonate or thermosetting materials such as polyester or epoxy resins and the like).

Each plunger 8 is solidly connected with the movable armature 7 and with a corresponding movable contact 32 to transmit mechanical forces to the movable contacts 32, when the movable armature 7 is actuated.

Each plunger 8 may be solidly fixed to the movable armature 7 and the corresponding movable contact 32 by means of fixing means of known type.

Preferably, each plunger 8 extends along a corresponding main longitudinal axis parallel (and preferably co-planar) to or coinciding with the displacement axis 33 of a corresponding movable contact 32 of the contactor.

Each plunger 8 is at least partially accommodated in the internal volume defined by the housing 35 of a corresponding electric pole 3.

The contactor 1 comprises an electromagnetic actuator 4.

The electromagnetic actuator 4 is advantageously part of the actuation section 12 of the contactor 1, at a distal position with respect to the movable contacts 32.

In practice, the electromagnetic actuator 4 is placed in a lower position with respect to the movable armature 7 taking as a reference a normal installation position of the contactor 1, as shown in the cited figures.

The electromagnetic actuator 4 is provided with a magnetic yoke 41-42 of ferromagnetic material of known type (e.g. Fe or Fe, Si, Ni, Co alloys) to form a magnetic circuit.

Figure 7:
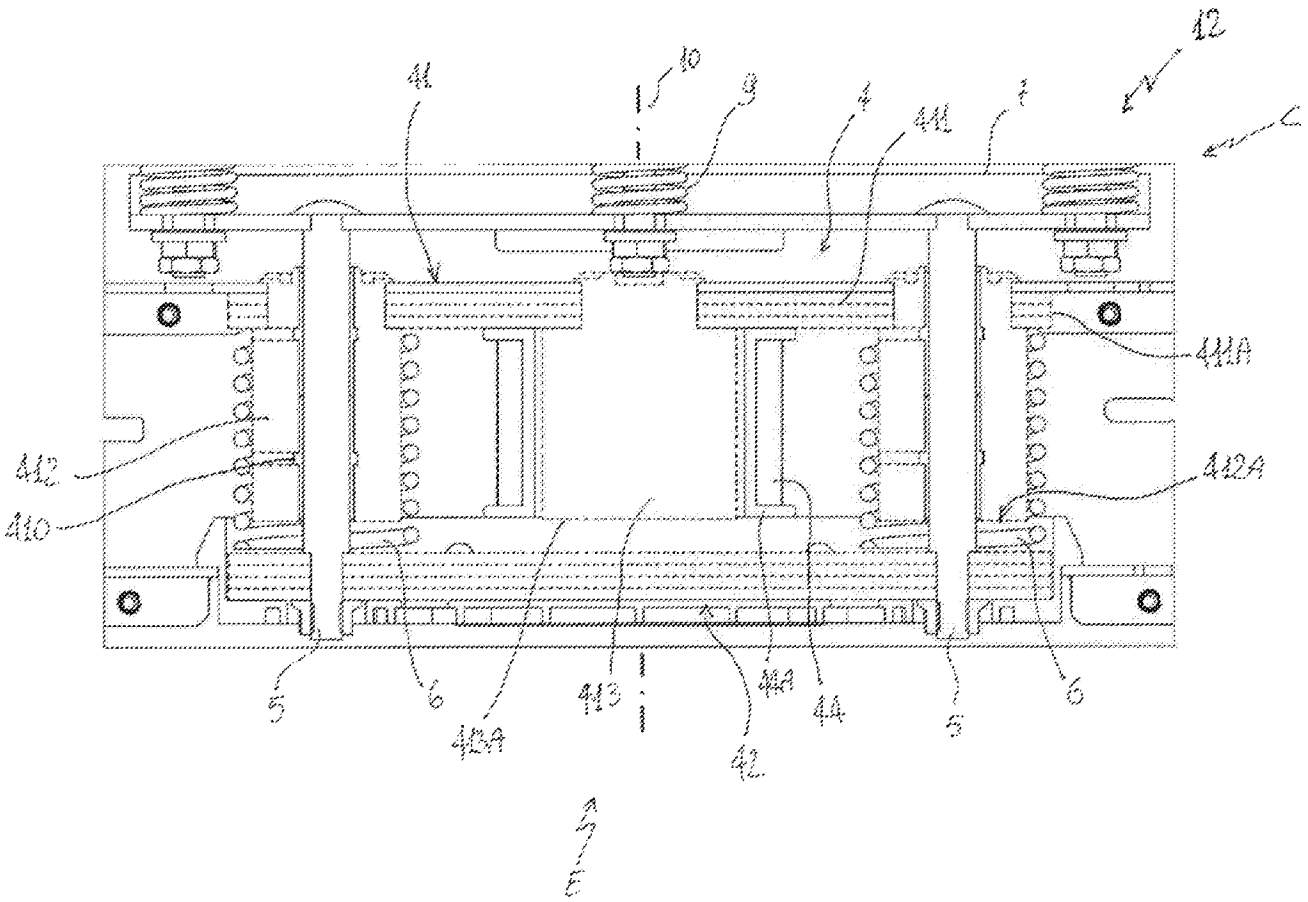
FIGS. 7-8, 8A are partial section views showing the actuation section of the contactor, according to the invention, in different operating positions.
Figure 8:
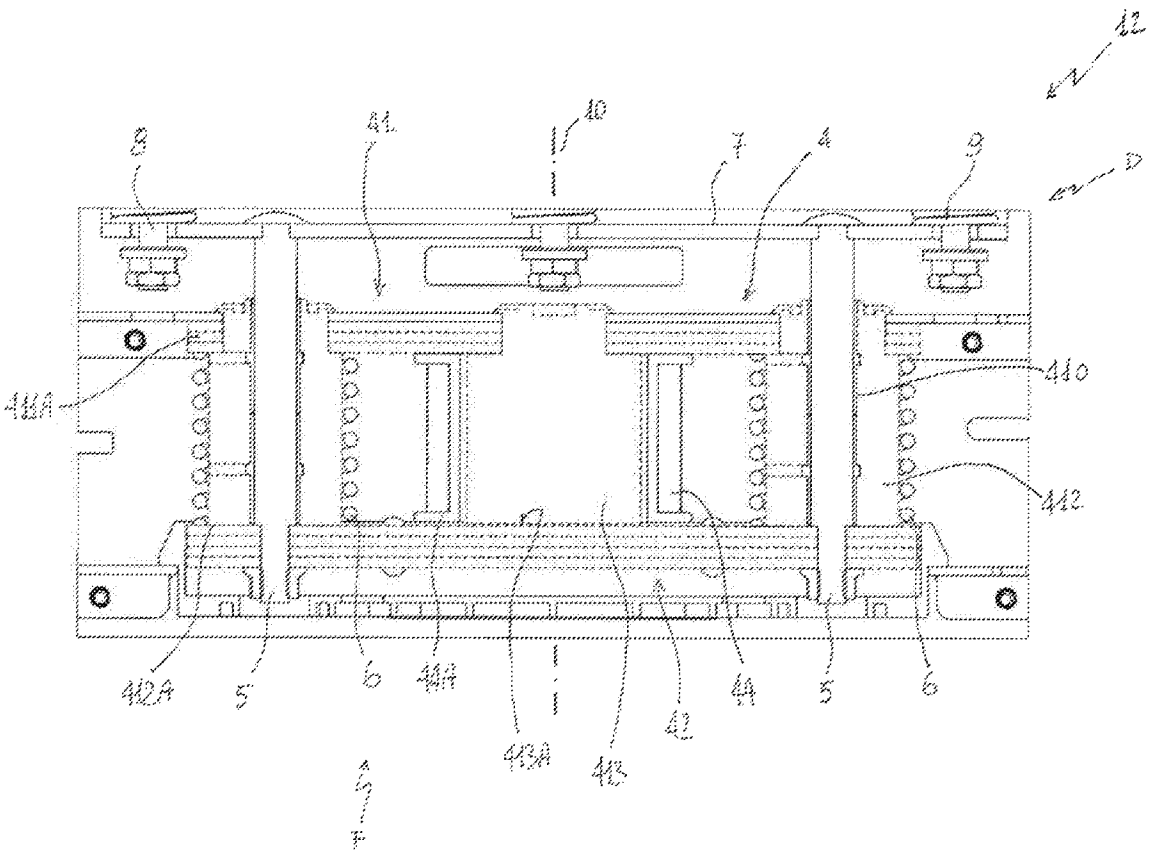
Figure 8A:
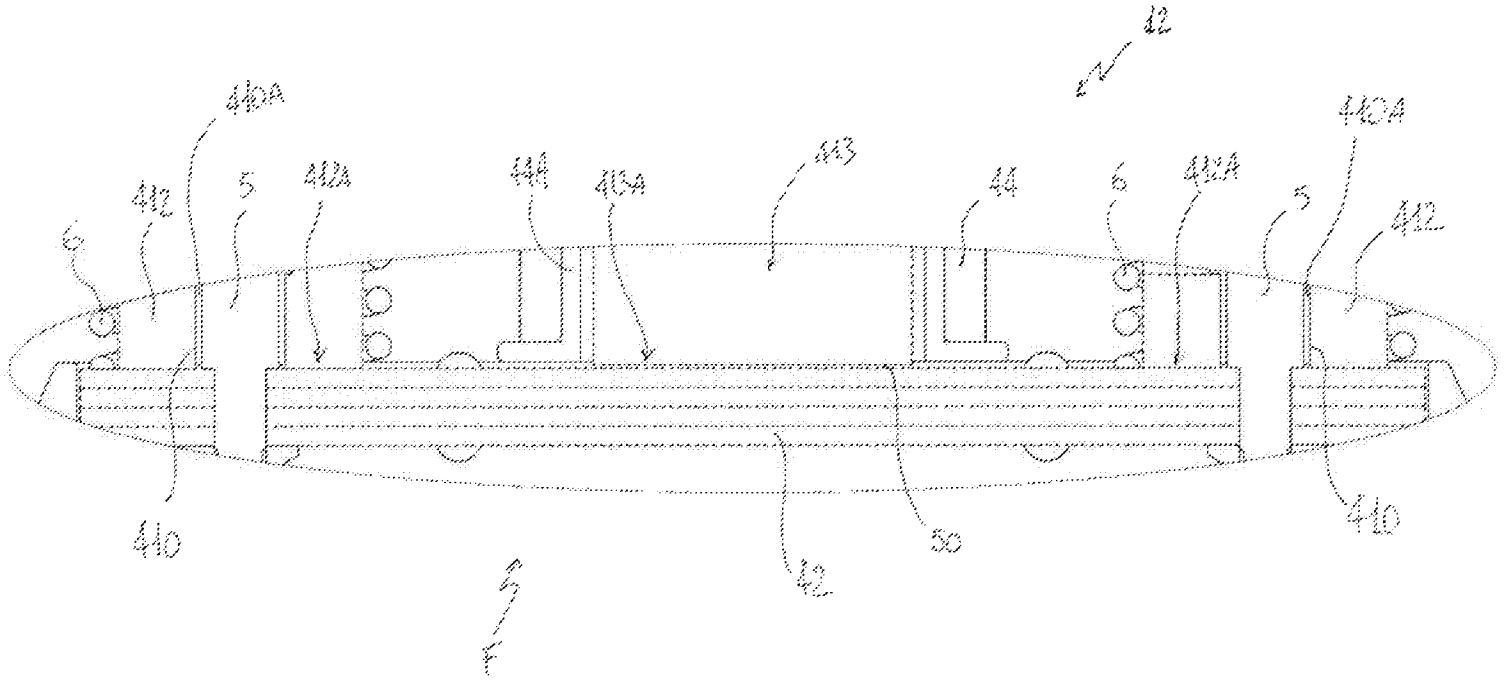

In the cited figures (see e.g. FIGS. 7-8), the parts made of ferromagnetic material of the magnetic yoke 41, 42 are shown with dotted lines for illustrative purposes only.

The magnetic yoke of the electromagnetic actuator 4 comprises a fixed yoke member 41 and a movable yoke member 42.

The fixed yoke member 41 may be solidly fixed to outer casing 2 of the contactor by means of fixing means of known type.

The movable yoke member 42 is reversibly movable, along a corresponding displacement direction parallel to, and preferably co-planar with, the displacement axes 33 of the movable contacts 32 (see the corresponding bi-directional displacement arrow FIG. 5).

In particular, the movable yoke member 42 is reversibly movable between a fifth position E, at which it is decoupled from the fixed yoke member 41, and a sixth position F, at which it is coupled with the fixed yoke member 41.

Advantageously, the fifth and sixth positions E, F of the movable yoke member 42 correspond respectively to the third and fourth positions C, D of the movable armature 7 and consequently, to the first and second positions A, B of the movable contacts 32.

In view of the above, it is evident that:

- the movable yoke member 42 passes from the fifth position E to the sixth position F to perform a closing manoeuver of the contactor;
- the movable yoke member 42 passes from the sixth position F to the fifth position E to perform an opening manoeuver of the contactor;
- when the the movable yoke member 42 is in the fifth position E, the movable contacts 32 are decoupled from the corresponding fixed contacts 31 (opening position);
- when the the movable yoke member 42 is in the sixth position F, the movable contacts 32 are coupled with the corresponding fixed contacts 31 (closing position).

The electromagnetic actuator 4 further comprises a coil 44 wound around the fixed yoke member 41.

The coil 44 is adapted to be electrically connected to an auxiliary power supply (not shown) so as to receive a coil current IC from this latter.

When the coil 44 is fed by a coil current IC, the fixed yoke member 41 magnetically interacts with the movable yoke member 42 as the magnetic flux generated by the coil current IC circulates along the magnetic circuit formed by the fixed yoke member 41 and the movable yoke member 42.

The magnetic interaction between the fixed yoke member 41 and the movable yoke member 42 makes the movable yoke member 42 to move from the fifth position E to the sixth position F, if the yoke members 41-42 are still decoupled, or makes the movable yoke member 42 to remain in the sixth position F, if the yoke members 41-42 are already coupled.

The magnetic interaction between the fixed yoke member 41 and the movable yoke member 42, in fact, causes the generation of a magnetic force that makes the movable yoke member 42 to couple or remain coupled with the fixed yoke member 41 in order to close any possible airgap between these two ferromagnetic elements.

Besides, it is evidenced that the above described interaction between the fixed yoke member 41 and the movable yoke member 42 occurs irrespectively of the direction of the coil current IC, which may thus be positive or negative according to the needs.

In view of the above, it is evident that the electromagnetic actuator 4 is adapted to provide a mechanical force to perform a closing operation (passage from the first position A to the second position B of the movable contacts 32) of the contactor or to provide a mechanical force to maintain the contactor in a closing state (movable contacts 32 in the second position B—closing position).

The contactor 1 comprises one or more opening springs 6 positioned between the fixed yoke member 41 and the movable yoke member 42.

The opening springs 6 store elastic energy when the movable yoke member 42 moves from the fifth position E to the sixth position F.

The opening springs 6 release the stored elastic energy to move the movable yoke member 41 from the sixth position F to the fifth position E, when the movable yoke member is free to move away from the sixth position F (i.e. when the fixed yoke member 41 and the movable yoke member 42 stop magnetically interacting upon interruption of the coil current IC feeding the coil 44).

In view of the above, it is evident that the opening springs 6 are adapted to provide a mechanical force to perform an opening operation (passage from the second position A to the first position A of the movable contacts 32) of the contactor.

Preferably, the opening springs 6 have their ends operatively connected with the fixed yoke member 41 and the movable yoke member 42, according to a fixing arrangement of known type.

Preferably, in order to ensure a proper positioning of the movable yoke member 42 and consequently of the movable contacts 32 during an opening manoeuver, the opening springs 6 are operatively installed in such a way to be in a biasing state (i.e. slightly compressed) when the movable yoke member 42 is in the sixth position F.

Preferably, the opening springs 6 are made of non-ferromagnetic material of known type (e.g. non-ferromagnetic stainless steel).

As it will better emerge from the following, the opening springs 6 are advantageously part of the actuation section 12 of the contactor 1 and are preferably structurally integrated with the electromagnetic actuator 4.

The contactor 1 comprises a plurality of second plungers 5 of non-ferromagnetic, electrically insulating material of known type (e.g. non-ferromagnetic stainless steel or other non-iron-based metallic materials).

Each plunger 5 is solidly connected with the movable yoke member 42 and the movable armature 7 to transmit mechanical forces to the movable armature 7 and consequently to the movable contacts 32, when the movable yoke member 42 is actuated by a magnetic force upon the magnetic interaction with the fixed yoke member 41 or by a force provided by the opening springs 6.

Each plunger 5 may be solidly fixed to the movable armature 7 and the movable yoke portion 42 by means of fixing means of known type.

Preferably, each plunger 5 extends along a corresponding main longitudinal axis parallel (and preferably co-planar) to the displacement axes 33 of the movable contacts 32 of the contactor. As it will better emerge from the following, the plungers 5 are advantageously part of the actuation section 12 of the contactor 1 and are preferably structurally integrated with the electromagnetic actuator 4.

Preferably, the contactor 1 comprises, for each electric pole 3, a contact spring 9 positioned between a corresponding fixed rest surface 91 and the movable armature 7.

The contact springs 9 store elastic energy when the movable armature 7 moves from the third position C to the fourth position D as a consequence of a movement of the movable yoke member 42 from the fifth position E to the sixth position F.

The contact springs 9 release the stored elastic energy when the movable armature 7 start moving from the fourth position D to the third position C, when the movable yoke member 42 is free to move from the sixth position F to the fifth position E.

Each contact spring 9 is adapted to provide a mechanical force directed in such a way to oppose to any separation of the electric contacts of the corresponding electric pole, when said electric contacts are in a closing position.

However, in view of the above, it is evident that the contact springs 9 are adapted to provide a mechanical force to start moving the movable contacts 32 of the contactor during an opening manoeuver of this latter.

As shown in the cited figures, the rest surface 91 for each contact spring 9 may be a surface portion of a shaped insulating element 91A accommodated in the internal volume defined by the housing 35 of a corresponding electric pole 3, in a distal position with respect to the movable contacts 32.

Preferably, the contact springs 9 have an end solidly with the movable armature 7 in a known manner and an opposite free end not connected with the respective rest surfaces 91.

As a consequence, when the movable armature 7 moves from the third position C to the fourth position D, the contact springs 9 move solidly with the movable armature 7 for a given distance and abut against the respective rest surfaces 91 (thereby being subject to compression) only when the movable armature 7 is in the nearby of the fourth position D.

Additionally, when the movable armature 7 moves from the fourth position D to the third position C, the contact springs 9 release the stored elastic energy and then decouple from the respective rest surfaces 91 and move solidly with the movable armature 7 for a given distance, until the movable armature reaches the third position C.

According to an embodiment of the invention (shown in the cited figures), the fixed yoke member 41 and the movable yoke member 42 are arranged respectively at a proximal position and a distal position with respect to the movable contacts 32.

In other words, according to this aspect of the invention, the fixed yoked member 41 is placed between the movable armature 7 and the movable yoke member 42.

According to this embodiment of the invention:

- the contactor 1 comprises a pair of second plungers 5 symmetrically positioned (i.e. equally spaced) with respect to a main symmetry plane 10 of the contactor, which is parallel to the displacement axes 33 of the movable contacts 32 and perpendicular to the displacement plane 34 of said movable contacts;
- the contactor 1 comprises a pair of opening springs 6 symmetrically positioned with respect to the main symmetry plane 10 of the contactor;
- the fixed yoke member 41 comprises a pair of through holes 410 passing through the whole thickness of the fixed yoke member 41 measured along the displacement plane 34 of the movable contacts 32. The through holes 410 are symmetrically positioned (i.e. equally spaced) with respect to a main symmetry plane 10 of the contactor and each second plunger 5 is inserted in a corresponding through hole 410 and passes through the fixed yoke member 41 to operatively connect the movable yoke member 42 and the movable armature 7.

This embodiment of the invention provides a high level of structural integration between the electromagnetic actuator 4, the second plungers 5 and the opening springs 6. This allows remarkably reducing the overall size of the actuation section 12 of the contactor 1.

Furthermore, the through holes 410 operate as coaxial guides for the plungers 5 of the contactor, thereby improving the movement precision of the plungers 5 and of the movable armature 7.

In addition, the symmetric arrangement of the electromagnetic actuator 4, the second plungers 5 and the opening springs 6 allows improving the distribution of forces transmitted to the movable contacts 32, thereby avoiding or mitigating possible load unbalances.

This allows reducing the mass of the components of the actuation chain of the movable contacts 32, e.g. the mass of the movable armature 7 and of the first and second plungers 8, 5 and, on the other hand, achieving high precision levels in positioning of the movable contacts and in terms of movement simultaneity with which said movable contacts are actuated.

Preferably, on the internal surface of each through holes 410, one or more elements or layers 410A of anti-friction material of known type (e.g. polymers such as PTFE, POM reinforced with lubricating additives such as molybdenum disulfide) are arranged to facilitate the sliding of the second plungers 5 during the maneuvers of the contactor.

According to an embodiment of the invention, the fixed yoke member 41 has an E-shaped structure, which is provided with a plurality of limb portions 412, 413 extending distally with respect to the movable contacts 32 of the contactor.

According to this embodiment of the invention, the fixed yoke member 41 comprises a main portion 411 in a proximal position with respect to the movable contacts 32.

Preferably, the main portion 411 is formed by a shaped beam of ferromagnetic material, which has a main longitudinal axis perpendicular to the displacement axes 33 of the second movable contacts 32 and parallel to the displacement plane 34 of said movable contacts.

The main portion 411 of the fixed yoke member 41 may be formed by a shaped packed beam structure including multiple overlapped strips of ferromagnetic material of known type (e.g. having thickness of 2-4 mm) and, possibly, one or more strips of electrically insulating material of known type.

Preferably, the main portion 411 has opposite free ends 411A, which are fixed to the outer casing 2 by means of suitable fixing means of known type.

According to this embodiment of the invention, the fixed yoke member 41 comprises a pair of lateral limb portions 412, each positioned at a corresponding end 411A of the main portion 411 and symmetrically arranged (i.e. equally spaced) with respect to the main symmetry plane 10 of the contactor.

The limb portions 412 protrude from the main portion 411 towards the movable yoke member 42, which is distally positioned with respect to the movable contacts 32.

Each of the limb portions 412 has a corresponding free end 412A in a distal position with respect to the movable contacts 32.

The free ends 412A of the lateral limb portions 412 are adapted to couple with the movable yoke member 42, when this latter reaches the sixth position F.

According to this embodiment of the invention, the fixed yoke member 41 further comprises an intermediate limb portion 413 positioned between the lateral limb portions 412.

The limb portion 413 protrudes from the main portion 411 towards the movable yoke member 42.

Preferably, the limb portion 413 is positioned along the main symmetry plane 10 of the contactor.

The limb portion 413 has a corresponding free end 413A in a distal position with respect to the movable contacts 32.

Preferably, the limb portion 413 is not intended to couple with the movable yoke member 42 during the operation of the contactor.

Thus, even when said movable yoke member in the sixth position F, the free end 413A of the intermediate limb portion 413 is still separated from the movable yoke member by an air gap 50.

This solution remarkably simplifies the manufacturing of the fixed yoke member 41 as lower tolerances can be employed in the realization of the of the limb portions 412, 413.

Further, it allows achieving an improved distribution of the magnetic flux along the magnetic circuit formed by the fixed yoke member 41 and the movable yoke member 42 when these latter ferromagnetic elements magnetically interact one with another.

Preferably, the fixed yoke member 41 comprises a pair of through holes 410, which are symmetrically positioned (i.e. equally spaced) with respect to the main symmetry plane 10 of the contactor and are coaxial with a corresponding lateral limb portion 412 thereof.

In practice, each through hole 410 passes through the whole length of the respective lateral limb portion 412 and the whole thickness of the main portion 411 at a corresponding end 411A of this latter.

Preferably, each second plungers 5 of the contactor is inserted in a corresponding through hole 410 and passes through a corresponding limb portion 412 and the main portion 411 of the fixed yoke member 41.

This solution further improves the precision of movement of the plungers 5 as these latter are guided by more extended coaxial guides.

Preferably, each opening spring 6 of the contactor is coupled with the main portion 411 of the fixed yoke member 41 and with the movable yoke member 42.

Preferably, each opening spring 6 is positioned coaxially with a corresponding limb portion 412 of the fixed yoke member 41 and outwardly surrounds said corresponding limb portion.

This solution remarkably simplifies the structure of the actuation section 12 of the contactor.

Further, the lateral limb portions 412 operate as guides for the opening springs 6 of the contactor, thereby improving the operation of these latter.

As shown in the cited figures, each of the limb portions 412 may be formed by hollow tubes (having a circular or polygonal section) of ferromagnetic material of known type that may be fixed to the main portion 411 by ferromagnetic fixing means of known type.

Similarly, the limb portions 413 may be formed by a solid tube (having a circular or polygonal section) of ferromagnetic material of known type that may be fixed to the main portion 411 by fixing means of known type.

This solution remarkably simplifies the manufacturing process of the fixed yoke member 41 as the limb portions 412, 413 may be easily obtained by means of an extrusion manufacturing process.

According to this embodiment of the invention, the movable yoke member 42 is formed by a shaped beam of ferromagnetic material of known type, which has a main longitudinal axis perpendicular to the displacement axes 33 of the second movable contacts 32 and parallel to the displacement plane 34 of said movable contacts.

The movable yoke member 42 may be formed by a shaped packed beam structure including multiple overlapped strips of ferromagnetic material of known type (e.g. having thickness of 2-4 mm) and, possibly, one or more strips of electrically insulating material of known type.

The operation of the contactor 1 is now described.

Opening State of the Contactor

When the contactor 1 is an opening state:

- the movable contacts 32 are in the first position A (opening position, i.e. decoupled from the fixed contacts 31), the movable armature 7 is in the third position C and the movable yoke member 42 is in the fifth position E, i.e. decoupled from the fixed yoke member 41 and separated from this latter by an airgap;
- the opening springs 6 are not compressed (with respect to their biasing state);
- the contact springs 9 are not compressed and are decoupled from the respective rest surfaces 91;
- the coil 44 is not fed and no magnetic field is generated;
- the fixed yoke member 41 and the movable yoke member 42 do not magnetically interact.

The opening state of the contactor 1 is stably maintained by the opening springs 6, which prevent any movement of the movable yoke member 42 away from the fifth position E, given the fact that other forces are not applied to this latter.

Closing Manoeuvre of the Contactor

Figure 9:
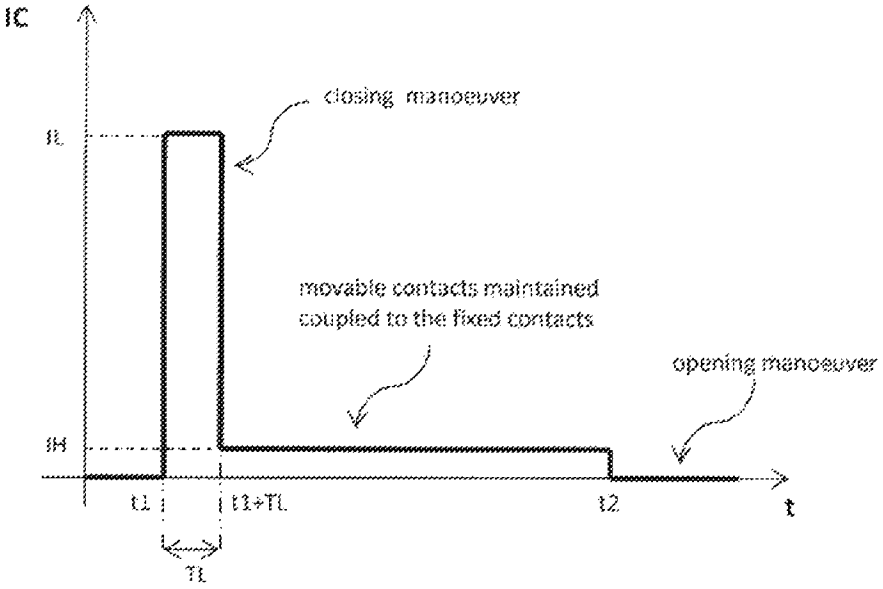
FIG. 9 shows a possible waveform for a coil current feeding the electromagnetic actuator of the contactor, according to the invention.

To perform a closing manoeuvre of the contactor 1, a coil current IC is supplied to the coil 44. Preferably, a launch current pulse, which has a launch value IL and a launch duration TL, is supplied (FIG. 9).

As the coil 44 is fed by the coil current IC, a magnetic flux is generated and circulates along the magnetic circuit formed by the fixed yoke member 41 and the movable yoke member 42.

As the fixed yoke member 41 and the movable yoke member 42 are initially separated by an airgap, a magnetic force is exerted on the movable yoke member 42 to close such an air gap. The movable yoke member 42 thus moves from the fifth position E to the sixth position F.

The launch value IL and the launch duration TL are advantageously set to obtain a magnetic force sufficiently high to move the movable yoke member 42 for a given distance against an opposition force exerted by the opening springs 6.

During the movement of the movable yoke member 42, the opening springs 6 are compressed, thereby storing elastic energy.

During its movement, the movable yoke member 42 transmits mechanical forces to the movable armature 7 through the second plungers 5.

The movable armature 7 thus moves from the third position C to the fourth position D.

When the movable armature 7 has reached a given distance to the fourth position D, the contact springs 9, which move together with the movable armature 7, come in contact with their respective rest surfaces 91 and start being compressed thereby storing elastic energy.

During its movement, the movable armature 7 transmits mechanical forces to the movable contacts 32 through the first plungers 8.

The movable contacts 32 move from the first position A to the second position B.

As soon as the movable contacts reach the second position B and couple with the respective fixed contacts 31, the opening maneuver is completed and the contactor 1 is in a closing state.

Closing State of the Contactor

When the contactor 1 is a closing state:

the movable contacts 32 are in the second position B (closing position, i.e. coupled with the fixed contacts 31), the movable armature 7 is in the fourth position D and the movable yoke member 42 is in the sixth position F, i.e. coupled with the fixed yoke member 41;

the opening springs 6 are compressed (with respect to their biasing state);

the contact springs 9 are compressed;

the coil 44 is still fed by a coil current IC, preferably having a holding value IH different than the launch value IL (FIG. 9), and a magnetic field is generated;

the fixed yoke member 41 and the movable yoke member 42 magnetically interact.

The closing state of the contactor is stably maintained by continuously feeding the coil 44, so that a magnetic force is continuously exerted on the movable yoke member 42 against an opposition force exerted by the opening springs 6 and the contact springs 9.

The holding value IH of the coil current IC is advantageously set to obtain a magnetic force sufficiently high to maintain the movable yoke member 42 coupled with the fixed yoke member 41 against an opposition force exerted by the opening springs 6 and the contact springs 9.

The holding value IH of the coil current IC may thus be lower than the launch value IL, so that the electric power dissipation of the coil 44 is reduced.

Opening Manoeuvre of the Contactor

To perform an opening manoeuvre of the contactor 1, the coil current IC supplied to the coil 44 is interrupted.

No magnetic force is exerted on the movable yoke member 42 anymore.

The opening springs 6 can release the stored elastic energy and exert a force to move the movable yoke member 42 from the sixth position F to the fifth position E.

During its movement, the movable yoke member 42 transmits mechanical forces to the movable armature 7 through the second plungers 5.

The movable armature 7 thus moves from the fourth position D to the third position C.

At the beginning of its movement, the movable armature 7 is further subject to a force exerted by the contact springs 9.

When the movable armature 7 has reached a given distance from the fourth position D, the contact springs 9, which move together with the movable armature 7, decouple from their respective rest surfaces 91.

During its movement, the movable armature 7 transmits mechanical forces to the movable contacts 32 through the first plungers 8.

The movable contacts 32 thus move from the second position B to the first position A.

As soon as the movable contacts reach the first position A, the opening maneuver is completed and the contactor 1 is in an opening state.

The contactor 1, according to the invention, provides remarkable advantages with respect to the known apparatuses of the state of the art.

In the contactor 1, the movable contacts 32 perform linear bidirectional movements that are driven by mechanical forces transmitted along axes parallel (and preferably coplanar) with the displacement axes 33 of the movable contacts. This solution provides a remarkable simplification of the actuation chain of the movable contacts 32, which allows improving the precision with which the movable contacts 32 are actuated.

The contactor 1, according to the invention, is thus characterised by high levels of reliability for the intended applications.

In the contactor 1, the electromagnetic actuator 4, the opening springs 6 and the plungers 5 are arranged with high levels of structural integration, which allows obtaining a very compact and robust actuation section with relevant benefits in terms of size optimization of the overall structure of the contactor.

The contactor 1, according to the invention, is of relatively easy and cheap industrial production and installation on the field.

The contactor 1 thus conceived is susceptible to numerous changes and variants, all of which are in the scope of the inventive concept as defined by the appended claims; additionally, all details can be replaced by other equivalent technical elements. For example, the number of elements as well as their configuration can be varied provided they are suitable for their scope; further, it is possible to perform any combination of the illustrative examples previously described. In practice, the materials, as well as the dimensions, can be of any kind depending on the requirements and state of the art.

The invention claimed is:

1. A contactor comprising:

an electric pole including:

a fixed contact and a movable contact, the movable contact being reversibly movable, along a displacement axis lying on a displacement plane, between a first position (A), at which said movable contact is decoupled from the fixed contact, and a second position (B), at which said movable contact is coupled with the fixed contact, and a first plunger coupled with the movable contact, the first plunger extending along a main longitudinal axis parallel or coinciding with the displacement axis;

a movable armature coupled with the first plunger and reversibly movable, along a displacement direction parallel to the displacement axis of said movable contact, between a third position (C) and a fourth position (D);

an electromagnetic actuator comprising a magnetic yoke having a fixed yoke member and a movable yoke member, said fixed yoke member comprising a pair of through holes, said fixed yoke member and said movable yoke member being arranged respectively at a proximal position and a distal position with respect to said movable contact, said movable yoke member being reversibly movable, along a displacement direction parallel to the displacement axis of said movable contact, between a fifth position (E), at which the movable yoke member is decoupled from said fixed yoke member, and a sixth position (F), at which the movable yoke member is coupled with said fixed yoke member, said electromagnetic actuator further comprising a coil wound around said fixed yoke member and adapted to be fed by a coil current (IC) to make said fixed yoke member to magnetically interact with said movable yoke member and generate a force to move said movable yoke member from said fifth position (E) to said sixth position (F) or maintain said movable yoke member in said sixth position (F);

a pair of opening springs coupled with said fixed yoke member and said movable yoke member, said opening springs being adapted to provide a force to move said movable yoke member from said sixth position (F) to said fifth position (E), the pair of opening springs being symmetrically positioned with respect to a main symmetry plane, which is parallel to the displacement axis of said movable contact and perpendicular to the displacement plane of said movable contact; and a pair of second plungers coupled with said movable yoke member and said movable armature, the pair of second plungers being symmetrically positioned with respect to the main symmetry plane of said contactor, each of said second plungers being inserted in a corresponding through hole and passing through said fixed yoke member.

2. The contactor, according to claim 1, wherein the displacement direction of said movable armature, the displacement direction of said movable yoke member, the main longitudinal axis of said first plunger lies on the displacement plane of said movable contact.

3. The contactor, according to claim 1, wherein the electric pole comprises a contact spring coupleable with a corresponding rest surface and coupled with said movable armature, each contact spring being adapted to provide a force to move said movable armature from said third position (C) towards said fourth position (D).

4. The contactor, according to claim 1, wherein said fixed yoke member comprises:

a main portion in a proximal position with respect to said movable contact and shaped as a beam having a main longitudinal axis perpendicular to the displacement axis of said movable contact and parallel to the displacement plane of said movable contact;

a pair of lateral limb portions, each positioned at a corresponding end of said main portion and protruding from said main portion towards said movable yoke member, each of said lateral limb portions having a corresponding free end in a distal position with respect to said movable contact, the free ends of said lateral limb portions being coupled with said movable yoke member, when said movable yoke member in said sixth position (F);

an intermediate limb portion positioned between said lateral limb portions and protruding from said main portion towards said movable yoke member, said intermediate limb portion having a corresponding free end in a distal position with respect to said main portion;

and wherein said movable yoke portion is shaped as a beam having a main longitudinal axis perpendicular to the displacement axis of said movable contact and parallel to the displacement plane of said movable contact.

5. The contactor, according to claim 4, wherein the free ends of said lateral limb portions are coupled with said movable yoke member, when said movable yoke member in said sixth position (F).

6. The contactor, according to claim 5, wherein the free end of said intermediate limb portion is separated from said movable yoke member, when said movable yoke member in said sixth position (F).

7. The contactor, according to claim 4, wherein the coil of said electromagnetic actuator is wound around the intermediate limb portion of said fixed yoke member.

8. The contactor, according to claim 4, wherein each through hole is coaxial with a corresponding lateral limb portion of said fixed yoke member, each second plunger being inserted in a corresponding through hole and passing through the coaxial corresponding lateral limb portion and said main portion.

9. The contactor, according to claim 4, wherein each opening spring is coupled with the main portion of said fixed yoke member and with said movable yoke member, each opening spring being positioned coaxially with a corresponding lateral limb portion of said fixed yoke member so as to outwardly surround said corresponding lateral limb portion.

10. The contactor, according to claim 1, wherein the electric pole comprises a vacuum chamber, in which the fixed contact and the movable contact are placed to be mutually coupled or decoupled.

11. The contactor, according to claim 1, wherein the contactor further comprises a plurality of electric poles.

12. The contactor, according to claim 1, wherein the contactor is configured to operate at medium voltage levels.

13. The contactor, according to claim 2, wherein the electric pole comprises a contact spring coupleable with a corresponding rest surface and coupled with said movable armature, each contact spring being adapted to provide a force to move said movable armature from said third position (C) towards said fourth position (D).

14. The contactor, according to claim 5, wherein the coil of said electromagnetic actuator is wound around the intermediate limb portion of said fixed yoke member.

15. The contactor, according to claim 6, wherein the coil of said electromagnetic actuator is wound around the intermediate limb portion of said fixed yoke member.

16. The contactor, according to claim 5, wherein each through hole is coaxial with a corresponding lateral limb portion of said fixed yoke member, each second plunger being inserted in a corresponding through hole and passing through the coaxial corresponding lateral limb portion and said main portion.

17. The contactor, according to claim 6, wherein each through hole is coaxial with a corresponding lateral limb portion of said fixed yoke member, each second plunger being inserted in a corresponding through hole and passing through the coaxial corresponding lateral limb portion and said main portion.

* * * * *